United States Patent [19]

Kölsch

[11] Patent Number: 4,663,787

[45] Date of Patent: May 12, 1987

[54] TANNING COT

[76] Inventor: Michael L. Kölsch, Frauenstrasse 14, 8 Munich 5, Fed. Rep. of Germany

[21] Appl. No.: 812,804

[22] Filed: Dec. 23, 1985

[51] Int. Cl.[4] ..... A47C 19/16; A47C 20/00

[52] U.S. Cl. ..... 5/110; 5/111; 5/314 R; 5/431; 128/376

[58] Field of Search ..... 5/110, 111, 114, 190, 5/226, 312, 314 R, 314 B, 431; 128/372, 373, 376, 377

[56] References Cited

U.S. PATENT DOCUMENTS

| | | | |
|---|---|---|---|
| 1,764,220 | 6/1930 | McLeod | 128/376 |
| 2,674,746 | 4/1954 | La Kaff | 5/110 |
| 2,756,441 | 7/1956 | Shannon | 5/111 |
| 2,834,351 | 5/1958 | Garson | 128/377 |
| 3,025,434 | 12/1971 | Kitover | 128/372 |
| 3,461,878 | 8/1969 | Southard | 128/376 |
| 3,949,435 | 4/1976 | Dionne | 5/431 |

FOREIGN PATENT DOCUMENTS

| | | | |
|---|---|---|---|
| 116294 | 9/1899 | Fed. Rep. of Germany | 128/376 |

*Primary Examiner*—Gary L. Smith
*Assistant Examiner*—Michael F. Trettel
*Attorney, Agent, or Firm*—Kokjer, Kircher, Bradley, Wharton, Bowman & Johnson

[57] ABSTRACT

An article of furniture in the nature of a cot for supporting a sunbather is disclosed. The cot comprises a rectangular, rigid frame of parallel extending, spaced apart frame members defining a planar peripheral support for a sheet of translucent, open mesh netting material stretched across the frame in position for supporting the sunbather's body. Foldable, U-shaped legs of tubular construction support the frame in vertical spaced relationship above a supporting surface. A pair of rectangular, planar reflectors are swingably secured to the frame side members to angle downwardly and inwardly beneath the supporting netting to reflect the sun's rays upwardly against the lower side of the sunbather's body. The frame members and the reflectors are constructed for folding at the middle of the cot to permit the article to be folded to a compact condition for transportability.

7 Claims, 9 Drawing Figures

Fig. 1.
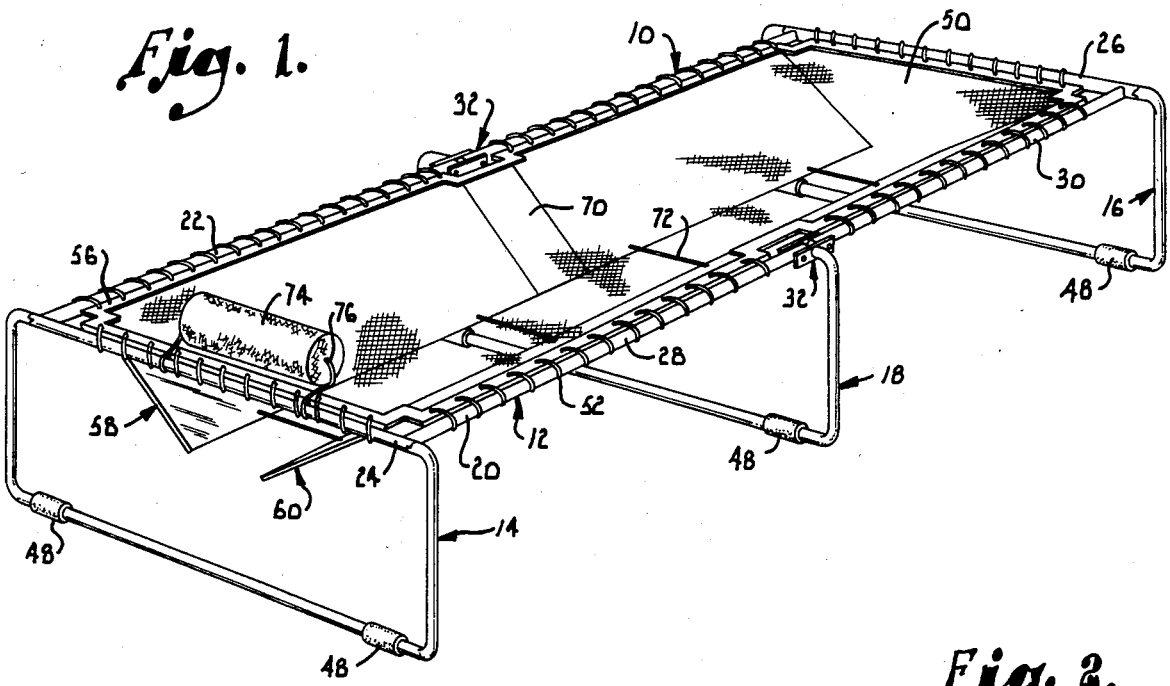
Fig. 2.
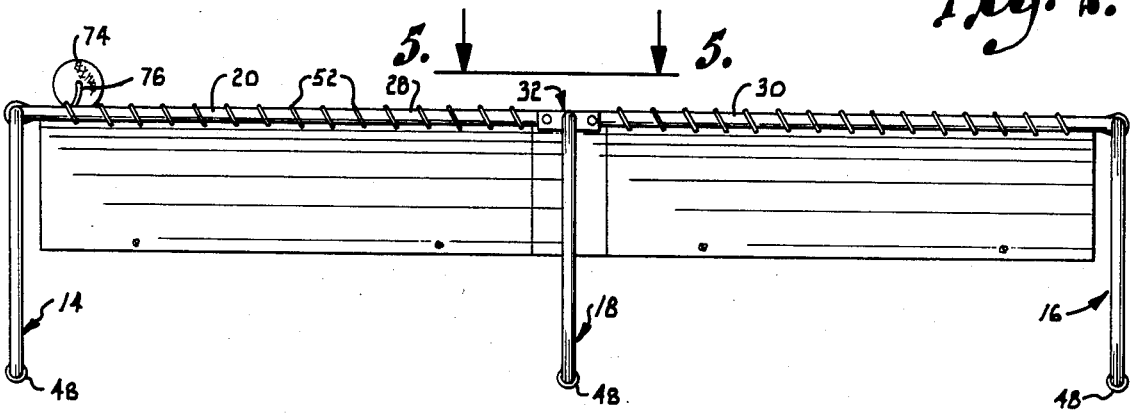
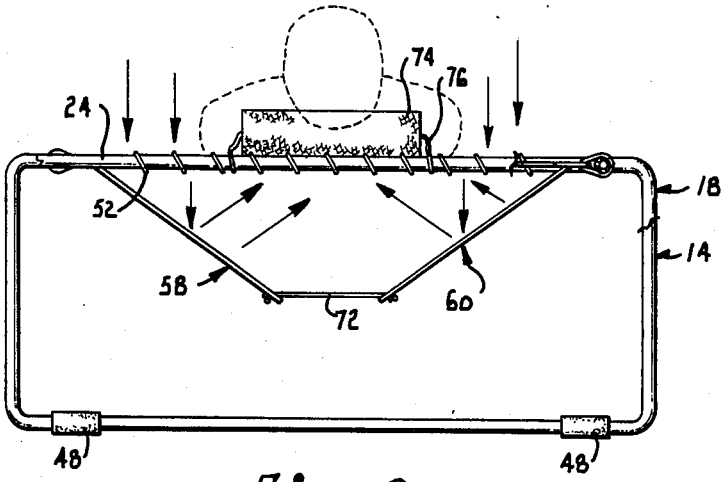
Fig. 3.
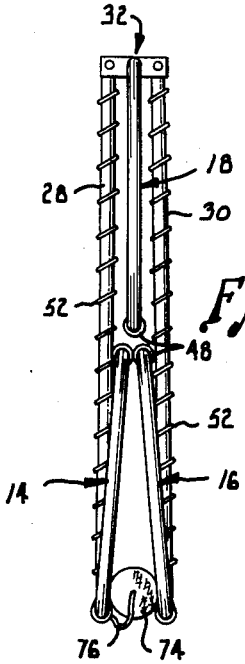
Fig. 4.

TANNING COT

This invention relates to furniture, and more particularly to an article of furniture for supporting a sun bather while obtaining a suntan.

Various articles have heretofore been suggested for supporting the human body while sunbathing and which are capable of reflecting the sun's rays in a manner to effect more uniform tanning of the body than would result from mere exposure to the direct rays of the sun. Some of these devices represent rather clumsy, expensive structures which are difficult to move around and are not practical for convenient use by the ordinary sunbather. Examples of structures of this type are disclosed in U.S. Pat. Nos. 407,434; 2,834,351; and 4,508,120.

Other devices representing attempts to provide supporting structures having reflecting surfaces to enhance the suntanning operation involve relatively flimsy items with inherent drawbacks and incapable of directing the suns rays in the manner required for optimum results. U.S. Pat. No. 3,835,482 discloses a shallow, water tight vessel or tub so that the user can lie in the water in the tub to keep cool while tanning. The user derives little, if any, benefit from the sun other than would be available without use of the device. U.S. Pat. No. 3,170,172 discloses an air mattress having a transparent upper surface and a reflective floor. The sunbather lies on the transparent surface and gets the benefit of the direct rays of the sun on his body as well as some limited benefit from the rays which are reflected from the floor surface. This latter structure suffers from the fact that the supporting surface is impervious to air flow. Hence, it is uncomfortable to the user. Further, the reflective panel also must serve as the support for the structure. Its location cannot be adjusted to the optimum position for obtaining uniform distribution of the sun's rays on the nether side of the sunbather for uniform tanning of the body. This structure also has the drawback of requiring that it be inflated at the bathing site. Otherwise, it is relatively large and unweldly for transport.

It is, therefore, a primary object of this invention to provide a structure for supporting the human body while sunbathing which overcomes the drawbacks incumbent upon the structures heretofore suggested for this purpose. In the achievement of this object, it is a very important object of this invention to provide a relatively inexpensive, lightweight yet sturdy supporting structure for a sunbather which is easily transportable and which is comfortable and efficient in use.

A very important object of the present invention is to provide a structure of this kind wherein the sunbather's body is supported on an open mesh netting which maintains the body in proper position for exposure to the direct and reflected rays of the sun, yet which permits unimpeded airflow around the body at all times.

A further object of the present invention is to provide an article of this type constructed from sturdy, yet lightweight materials and designed for folding into a collapsed, easily portable compact condition.

A further important object of the present invention is to provide such a structure wherein the reflectors can be easily adjusted to whatever positions may be required for best distribution and utilization of the rays of the sun.

These and other important aims and objectives of the invention will be further explained or will become apparent from the following description and explanation of the drawings, wherein:

FIG. 1 is a perspective view of a presently preferred article of furniture embodying the principles of this invention;

FIG. 2 is a side elevational view thereof;

FIG. 3 is an end elevational view thereof, the outline of a user appearing in phantom in position on the article, and arrows illustrating the paths of the rays of the sun;

FIG. 4 is a side elevational view of the article in its folded condition;

Figure 5:
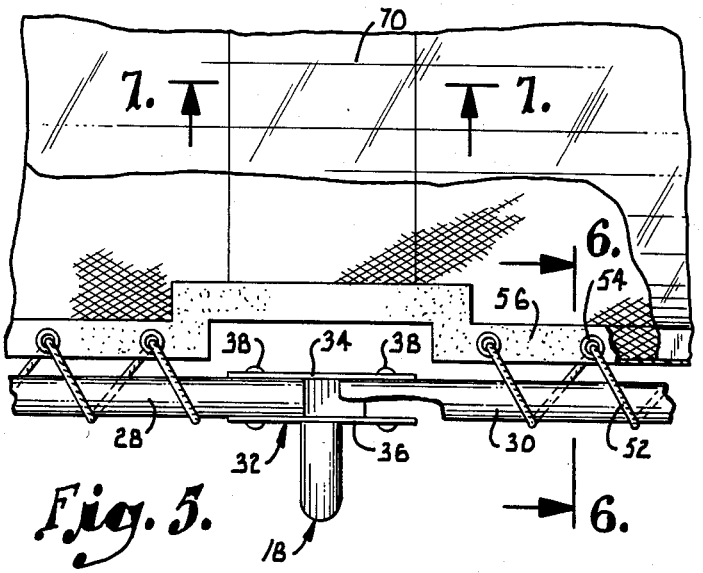
FIG. 5 is an enlarged, fragmentary plan view taken along line 5—5 of FIG. 2, parts being broken away to show details of construction.

A presently preferred embodiment of the principles of this invention is an article of furniture in the form of a cot broadly designated in the drawings by the reference numeral 10 and comprising a rigid frame 12 supported at each end by legs 14 and 16 and at the middle by a leg 18. Frame 14 includes a pair of elongated, rigid, spaced apart, parallel side members 20 and 22 interconnected at their ends by a pair of mutually similar, spaced apart, parallel end members 24 and 26 to define a peripherally extending, planar, rectangular frame as shown in FIG. 1.

The side members 20 and 22 are each comprised of a pair of substantially identical tubular sections 28 and 30 with one end of each section rigidly secured to the corresponding end member 24 or 26 and the free ends of the sections interconnected at the midregion of the cot by a hinge 32 in the manner illustrated best in FIG. 5 of the drawings. Hinge 32 comprises a pair of spaced part, rigid straps 34 and 36 to which the frame sections 28 and 30 are pivotally connected as by rivets 38 for swinging of the sections as will be apparent. Leg 18 comprises an elongated, rigid tube bent into substantially a U-shaped configuration as shown in the drawings with the free ends of the leg rigidly secured to the respective hinges 32 at each side of the frame as illustrated.

Figure 8:
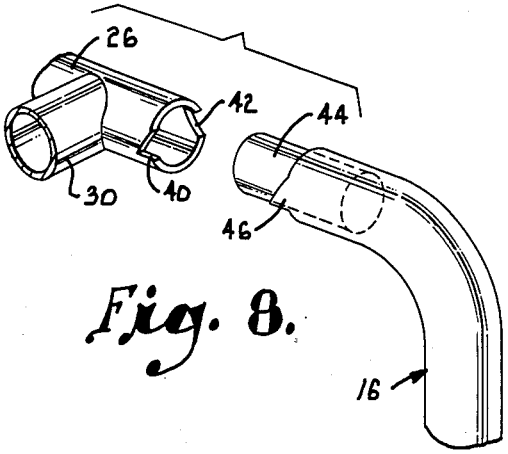
FIG. 8 is, a fragmentary, exploded perspective view of an end leg hinge on the scale of FIG. 6.
Figure 9:
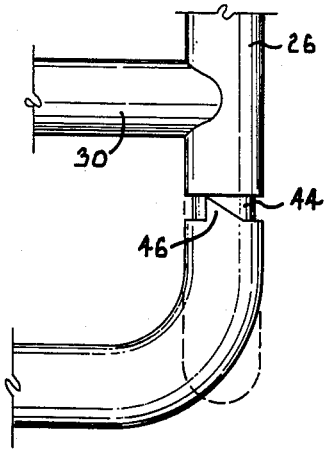
FIG. 9 is a top plan view of the hinge of FIG. 8 in its assembled condition and rotated to the folded position, the extended position of the leg being shown in phantom.

Legs 14 and 16 are preferably constructed substantially identically to leg 18 except for the manner in which the end legs are hinged to the frame. This connection is best illustrated in FIGS. 8 and 9 of the drawings illustrating that the end members 24 and 26 project outwardly beyond the corresponding side member sections 28 and 30. The outermost ends of the members 24 and 26 are configured as shown in FIG. 8. Thus, each end is provided with a pair of oppositely positioned grooves, each groove having one straight surface 40 extending substantially parallel with the longitudinal axis of the member, and one angled surface 42 extending at an angle to the longitudinal axis.

The free ends of the legs 14 and 16 are each fitted with a tubular insert 44 having an outside diameter of a size to fit snugly into the leg tube and into the tube comprising the frame end member. The inserts 44 are secured by any suitable means such as staking or the like to the leg tubes in positions projecting therefrom as illustrated in FIG. 8. The projecting ends of the inserts 44 are received within the projecting ends of the end members and the ends of the leg tubes are provided with a pair of projections 46 configured to complementally fit the grooves on the frame end members when the legs are in the frame supporting positions shown in FIGS. 1-3 of the drawings. The legs are constructed so that the inherent resiliency of the U-shaped legs urge the latter into a tight, complemental fit with the projections 46 engaged in the corresponding grooves in the ends of the end members when the legs are in the supporting positions. The elasticity of the U-shaped legs 14 and 16 permit the upright stretches of the legs to be cammed outwardly when a force is exerted against the legs in a direction to fold the latter under the cot with the angled surfaces of the projections 46 sliding on the angled surfaces 42 of the grooves. Obviously, the interlocked straight surfaces of the projections and grooves prevent such camming action when forces are exerted against the legs in the opposite directions.

If desired, the legs may be provided with feet in the form of a plurality of tubular protectors 48 telescoped over the legs. Preferably, the protectors 48 are of resilient materials such as rubber or the like to impart a degree of cushion and skid resistance.

Means for supporting the body on the cot while sunbathing to permit the free passage of the sun's rays and also to permit the free circulation of air around the supported body is provided in the form of a flexible sheet of open mesh netting 50. Desirably, netting 50 is fabricated from relatively translucent, strong material such as nylon or the like. The sizes of the mesh openings is not critical. However, the weave should be sufficiently open to permit relatively unimpeded air circulation. The netting is stretched over the frame and secured to the latter by means of an elongated, flexible element such as a rope 52 wound around the respective frame side members 20 and 22 as well as the frame end members 24 and 26 as shown in the drawings. Rope 52 is passed through a series of spaced apart grommets 54 received in a tape 56 secured to and extending around the peripheral margin of netting 50 as illustrated.

Figure 7:
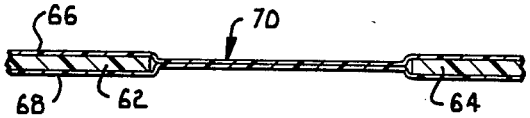
FIG. 7 is a still further enlarged fragmentary cross-sectional view taken along line 7—7 of FIG. 5.

Means for reflecting the sun's rays onto a sunbather's body from beneath the netting comprises a pair of elongated, rectangular, identical reflectors 58 and 60 carried by the frame. Each reflector comprises a pair of rigid panels 62 and 64 extending in longitudinally aligned, end to end relationship from the corresponding end frame members 24 and 26 respectively with the panels spaced apart in the region of the hinges 32 as shown in the drawings. The panels 62 and 64 are preferably constructed with a covering sheet of flexible material 66 and a bottom sheet of flexible material 68 as illustrated best in FIG. 7. The sheets of flexible material span the distance between the aligned panels 62 and 64 and may be secured together throughout the spacing between the panels to provide a strip 70 of foldable material interconnecting the panels of a reflector proximal the region of the aligned hinges 32 at the midregion of the cot. The upper surface of the material 66 is coated or otherwise provided with a reflective material so that each reflector is capable of reflecting the sun's rays throughout substantially the entire length of the reflector.

Figure 6:
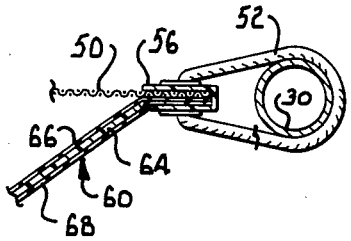
FIG. 6 is a further enlarged, fragmentary cross sectional view taken along line 6—6 of FIG. 5.

The edge of each reflector proximal the frame side members 20 and 22 are secured to such members, preferably by securing the sheets of material 66 and 68 to the tape 56 as by stitching or the like as illustrated in FIG. 6. Thus, the netting 50 and the reflectors may be secured together along their respective marginal edges by the tape with the grommets 54 extending through these joined components for enhanced strength and attachment to the frame by means of rope 52. The reflectors 58 and 60 are swingable with respect to the frame and with respect to the netting 50 along the marginal edges which are secured to and extend parallel with the frame side members 20 and 22.

The lowermost, projecting marginal edges of the reflectors 58 and 60 are releaseably secured together to dispose the reflectors at downwardly and inwardly angled relationship with respect to the supporting net 50 whereby the reflectors converge as the projecting ends of the latter are approached. To this end, a plurality of longitudinally spaced apart, flexible elements in the nature of ropes or cords 72 may be received and tied through appropriate holes extending through the reflectors as illustrated in the drawings. The cords 72 are of lengths required to hold the reflectors, rigidified by the rigid panels 62 and 64, in the positions illustrated when the cot is in its unfolded condition as shown in FIGS. 1-3 of the drawings.

An adjunct for providing comfortable support to a user of the cot may be provided in the nature of a pillow 74, preferably of relatively soft, tubular construction and secured to one frame end member 24 by a flexible string 76. The string 76 is of sufficient length to permit the pillow to be moved within limits to the position desired by the user, yet to permit the pillow to be swung to a position which does not impede the folding of the cot when not in use as will be subsequently explained.

In operation, the cot 10 is unfolded to the position illustrated in FIGS. 1-3 for use by a sunbather. The user may lie on the supporting netting with the cot positioned for optimum exposure to the rays of the sun. At the same time, the rays which do not impinge directly on the user's body are reflected as illustrated in FIG. 3 to the lower side of the body to provide a uniform tan to the sunbather. The reflectors are spaced sufficiently from the user's body for optimum reflection of the sun's rays and the angles of the reflectors can be conveniently adjusted by lengthening or shortening the respective cords 72 as will be readily understood. Throughout the entire procedure, free air circulation is permitted in and around the supporting structure and particularly through the open mesh of the netting 50. Further, the body supporting netting need not impair the tanning process, particularly in view of the translucent character of the netting material.

When it is desired to fold the cot for transporting or storage, the end legs 14 and 16 are rotated to positions extending in general planar alignment with the plane of the frame 12 as has been heretofore explained. The frame side member sections 28 and 30 are swung on the hinges 32 to extend in general parallelism with the intermediate leg 18 as shown in FIG. 4. This folding is permitted by virtue of the flexible nature of the sheet of netting 50 and by the foldable strip of material 70 interposed between the rigid panels 62 and 64 of the reflectors. The cot in its folded condition represents a compact arrangement as illustrated in FIG. 4, occupying a substantially small space and being quite portable. The tubular nature of the frame members and the legs results in a relatively lightweight article which adds to the ease by which it may be transported to and from the sunbathing location.

While the principles of this invention have been described in connection with a construction in the nature of a portable cot, it will be recognized by those skilled in the art that such principles are adaptable to other articles and embodiments. For example, the article might be constructed in the form of a chair, chaise lounge or the like, incorporating an open netting support material with associated reflectors for maximizing the tanning effect of the sun's rays on the user's body.

While the reflectors described in conjunction with the description of the presently preferred embodiment are planar, it is within the scope of this invention that the reflectors may have other shapes consistent with reflecting the sun's rays onto the body of the user in the manner considered desirable for obtaining a tan. Thus, for example, the reflectors might be transversely arcuate to better focus the reflected rays for this purpose. Each reflector could, of course, have a parabolic shape in transverse cross section for this purpose. Alternatively, the two reflectors may be shaped in a manner so that each comprises a segment of a composite parabolic surface consisting of both reflectors and having a focus appropriate for optimum tanning results.

A variety of other modifications will be readily suggested to those skilled in the art without departing from the principles of this invention.

Having thus described the invention, I claim:

1. An article of furniture to support a sunbather for enhanced exposure to tanning by the rays of the sun, said article comprising:

a sheet of open mesh flexible meeting;

a rigid frame extending around the periphery of the netting, the peripheral margin of the latter being secured to the frame with the netting stretched across the frame;

means for supporting the frame in vertically spaced relationship above a supporting surface;

reflector means carried by the frame and extending at an angle beneath the netting in disposition to reflect the rays of the sun upwardly through the netting and onto the sunbather's body when the latter is supported on the netting: and said frame and said reflector means each being constructed of at least two distinct rigid sections, said article including foldable hinge means for the frame and reflector sections respectively, said hinge means interconnecting to corresponding sections to permit folding of the article to compact the latter for transport and storage.

2. An article of furniture as set forth in claim 1, wherein said frame is rectangular including a pair of spaced apart frame sides, and wherein said reflector means includes a pair of planar reflectors, one for each side of the frame respectively, each reflector being carried by its corresponding side of the frame, said reflectors extending downwardly and inwardly in mutually converging relationship, whereby to reflect the sun's rays relatively uniformly against the lower side of said sunbather's body.

3. An article as set forth in claim 2, wherein said frame is elongated and includes a pair of elongated, spaced apart rigid side members interconnected by a pair of elongated, spaced apart, rigid end members, each side member comprising a pair of substantially identical sections, and hinge means interconnecting each pair of sections intermediate the ends of the frame, whereby the latter may be folded at said hinge means for convenient storage and transport of the article.

4. An article as set forth in claim 3, wherein each of said reflectors comprises a pair of elongated, rigid reflector panels, there being a panel for each end of the frame respectively, an end of each panel expanding from proximal its corresponding end of the frame and in general alignment with the other panel of said pair, the other ends of the pair of panels terminating in mutually spaced apart relationship in the region of the frame section hinge means; and a strip of flexible, reflective material interconnecting said other ends of the panels, said reflectors being swingably secured to the frame, whereby each reflector extends substantially the full length of the frame for enhanced tanning of the sunbather, and the reflectors may be swung into generally planar alignment with the netting and folded at the flexible strip for folding with the frame.

5. An article as set forth in claim 4, wherein each of said reflectors is rectangular, and wherein said article includes a plurality of elongated, flexible elements, each element being secured to each of said reflectors for holding the latter in said angled, converging positions, the elements being disposed in spaced apart relationship along the reflectors.

6. An article of furniture to support a sunbather for enhanced exposure to the rays of the sun, said article comprising:

a rigid, planar rectangular frame including a pair of rigid, elongated, spaced apart, mutually parallel side members and a pair of rigid, elongated, spaced apart mutually parallel end members interconnected to define a periphery;

a sheet of flexible open mesh netting secured around its peripheral margin to the frame to stretch said sheet across the frame, each frame side member including a pair of substantially identical sections;

a hinge for each pair of sections, the hinge being secured to its corresponding sections for swinging about the hinge from a position with the sections of the pair extending in end to end longitudinal alignment to a position with said sections extending in substantially mutual parallelism;

an elongated, rectangular reflector having side edges for each frame side member respectively, each reflector being swingable secured along one side edge to its corresponding frame side member for swinging between a position in general planar alignment with the netting sheet to a position extending downwardly at an angle from the plane of said sheet, each reflector including a pair of rigid reflective panels disposed end to end, spaced apart longitudinal alignment, and a strip of flexible reflective material interconnecting said panels in the region of the frame section hinges to permit folding the reflectors at said region;

means for releaseably securing the reflectors in said downwardly angled positions; and leg means carried by the frame and adapted to support the latter in vertically spaced, generally horizontal disposition above a supporting surface, whereby the sun's rays may fall directly on a sunbather on the netting and be reflected upwardly against the underside of the sunbather through the netting by said reflectors.

7. An article as set forth in claim 6, wherein said leg means includes three generally U-shaped legs including a leg for each respective end of the frame, and a leg intermediate said ends in disposition to support the respective frame side members in the region of said hinges, the end legs being swingably secured to the frame for swinging to positions in general alignment with the frame sections, whereby the article may be compactly folded.

* * * * *